US009605504B2

(12) United States Patent
Leuchtenberg et al.

(10) Patent No.: US 9,605,504 B2
(45) Date of Patent: Mar. 28, 2017

(54) SEALING ASSEMBLY

(75) Inventors: Christian Leuchtenberg, Singapore (SG); Alexander John MacGregor, The Lakeshore (SG)

(73) Assignee: MANAGED PRESSURE OPERATIONS PTE LTD, Singapore (SG)

( * ) Notice: Subject to any disclaimer, the term of this patent is extended or adjusted under 35 U.S.C. 154(b) by 360 days.

(21) Appl. No.: 14/006,827

(22) PCT Filed: Oct. 12, 2011

(86) PCT No.: PCT/GB2011/051971

§ 371 (c)(1),
(2), (4) Date: Nov. 21, 2013

(87) PCT Pub. No.: WO2012/127180

PCT Pub. Date: Sep. 27, 2012

(65) Prior Publication Data

US 2015/0369000 A1 Dec. 24, 2015

(30) Foreign Application Priority Data

Mar. 23, 2011 (GB) ..... 1104885.7
Apr. 13, 2011 (GB) ..... PCT/GB2011/050737

(51) Int. Cl.
*E21B 33/06* (2006.01)
*E21B 33/08* (2006.01)
*E21B 21/08* (2006.01)

(52) U.S. Cl.
CPC ..... *E21B 33/06* (2013.01); *E21B 21/08* (2013.01); *E21B 33/085* (2013.01)

(58) Field of Classification Search
CPC ..... E21B 33/06; E21B 33/061; E21B 33/085
See application file for complete search history.

(56) References Cited

U.S. PATENT DOCUMENTS 1,861,726 A 6/1932 Trout
2,155,837 A 4/1939 Penick et al.
(Continued)

FOREIGN PATENT DOCUMENTS

EP 1061231 1/2001
EP 1659260 5/2006
(Continued)

OTHER PUBLICATIONS

International Search Report for PCT/GB2012/050615 dated Mar. 20, 2013.
(Continued)

*Primary Examiner* — David Andrews
(74) *Attorney, Agent, or Firm* — Norman B. Thot

(57) ABSTRACT

A pressure containment device for sealing around a tubular body comprising an actuator assembly and a seal assembly, the actuator assembly being operable to engage with the seal assembly to prevent significant rotation of the seal assembly with respect to the actuator assembly and to force the seal assembly into sealing engagement with a tubular body mounted in the pressure containment device, the seal assembly comprising a tubular seal sleeve having a radially inward portion made from a non-elastomeric polymer, and a radially outward portion made from an elastomer.

17 Claims, 7 Drawing Sheets

(56) References Cited

U.S. PATENT DOCUMENTS

Figure 1:
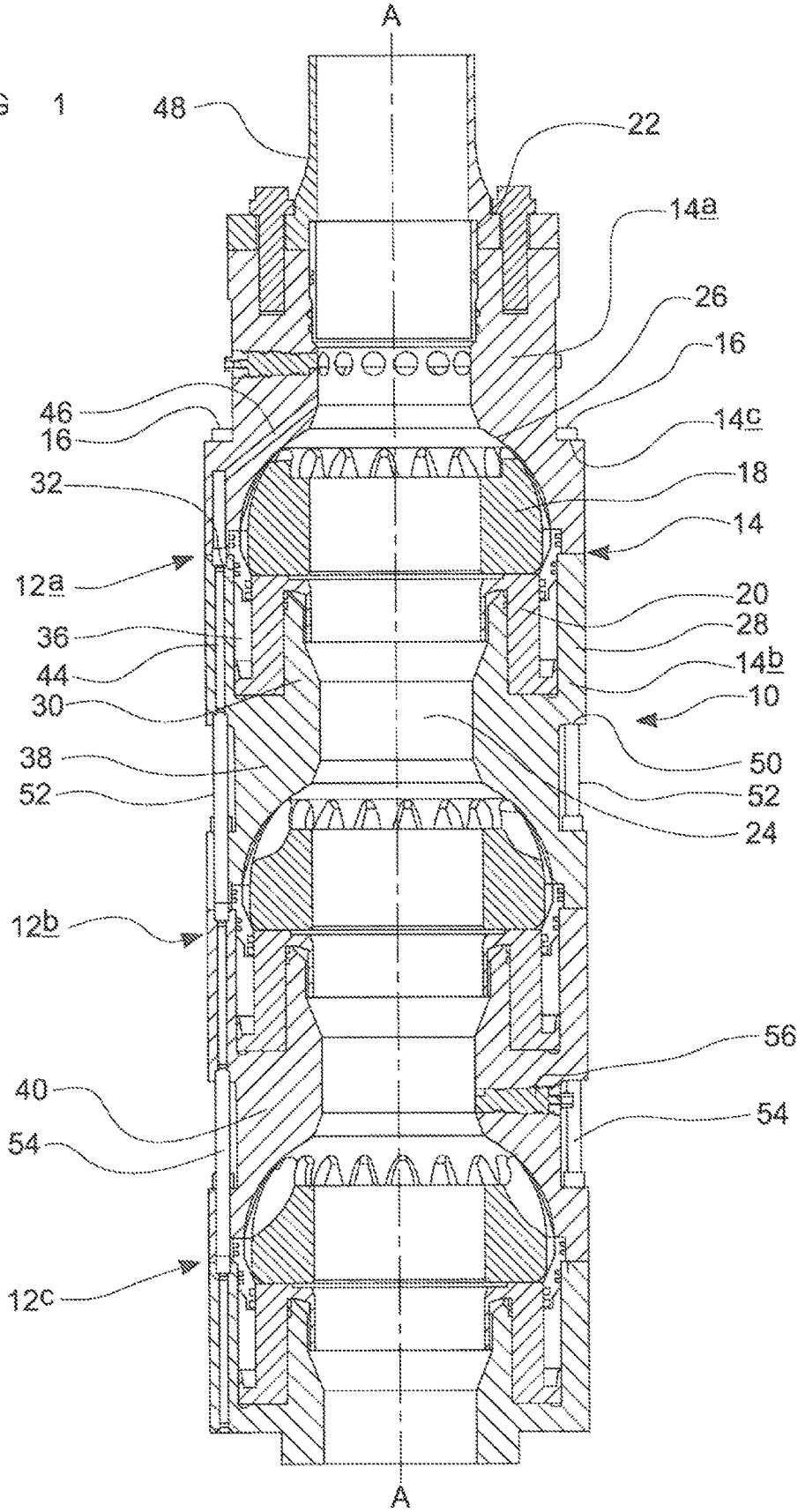

| | | | | |
|---|---|---|---|---|
| 2,192,805 | A | 3/1940 | Cecil | |
| 2,731,281 | A | 1/1956 | Knox | |
| 2,904,357 | A | 9/1959 | Knox | |
| 3,168,320 | A | 2/1965 | Sneed | |
| 3,225,831 | A | 12/1965 | Knox | |
| 3,561,723 | A | 2/1971 | Cugini | |
| 3,614,111 | A | 10/1971 | Regan | |
| 3,667,721 | A | 6/1972 | Vujasinovic | |
| 3,827,487 | A | 8/1974 | Jackson et al. | |
| 3,871,665 | A | 3/1975 | Burke et al. | |
| 4,283,039 | A * | 8/1981 | Schaeper | E21B 33/06 251/1.2 |
| 4,358,085 | A | 11/1982 | Regan et al. | |
| 4,361,185 | A | 11/1982 | Biffle | |
| 4,508,311 | A * | 4/1985 | Just | E21B 33/06 251/1.2 |
| 4,949,785 | A | 8/1990 | Beard et al. | |
| 5,074,518 | A | 12/1991 | Berry | |
| 5,080,174 | A | 1/1992 | Hynes | |
| 5,100,950 | A | 3/1992 | Carlson et al. | |
| 5,178,215 | A | 1/1993 | Yenulis et al. | |
| 5,224,557 | A | 7/1993 | Yenulis et al. | |
| 5,273,108 | A | 12/1993 | Piper | |
| 5,361,832 | A | 11/1994 | Van Winkle | |
| 6,109,348 | A | 8/2000 | Caraway | |
| 6,129,152 | A | 10/2000 | Hosie et al. | |
| 6,554,016 | B2 | 4/2003 | Kinder | |
| RE38,249 | E | 9/2003 | Tasson et al. | |
| 6,749,172 | B2 | 6/2004 | Kinder | |
| 6,896,076 | B2 | 5/2005 | Nelson et al. | |
| 7,004,444 | B2 | 2/2006 | Kinder | |
| 7,007,913 | B2 | 3/2006 | Kinder | |
| 7,040,394 | B2 | 5/2006 | Bailey et al. | |
| 7,380,590 | B2 | 6/2008 | Hughes et al. | |
| 7,699,109 | B2 | 4/2010 | May et al. | |
| 7,926,560 | B2 | 4/2011 | Bailey et al. | |
| 2004/0113108 | A1 | 6/2004 | Ward | |
| 2008/0302536 | A1 | 12/2008 | Kotrla | |
| 2009/0161997 | A1 | 6/2009 | Beauchamp et al. | |
| 2011/0024195 | A1 | 2/2011 | Hoyer et al. | |

FOREIGN PATENT DOCUMENTS

| | | |
|---|---|---|
| GB | 326615 | 1/1929 |
| GB | 627196 | 8/1947 |
| GB | 1294288 | 10/1972 |
| RU | 2198282 | 2/2003 |
| WO | WO9807956 | 2/1998 |
| WO | 2007008085 | 1/2007 |
| WO | WO2008024265 | 2/2008 |
| WO | 2008133523 | 11/2008 |
| WO | 2009017418 | 2/2009 |
| WO | W02009017418 | 2/2009 |
| WO | WO2009021037 | 2/2009 |
| WO | 2011093714 | 8/2011 |
| WO | 2011128690 | 10/2011 |

OTHER PUBLICATIONS

Search Report issued in GB1104885.7 dated Apr. 18, 2011.
International Search Report issued in PCT/GB2011/051971 dated Nov. 29, 2012.
International Search Report issued in PCT/GB2011/050737.

* cited by examiner

SEALING ASSEMBLY

CROSS REFERENCE TO RELATED APPLICATIONS

This application is a continuation of PCT/GB2011/051971, filed 12 Oct. 2011, and entitled "Sealing Assembly," which claims priority under 35 U.S.C. §119 to GB Application No. GB1104885.7, filed on 23 Mar. 2011, and PCT/GB2011/050737 filed 13 Apr. 2011, the entire contents of each are hereby incorporated by reference.

DESCRIPTION OF INVENTION

The present invention relates to a method and an apparatus for sealing around a drill pipe during drilling of a well bore.

Subterranean drilling typically involves rotating a drill bit from surface or on a downhole motor at the remote end of a tubular drill string. It involves pumping a fluid down the inside of the tubular drillstring, through the drill bit, and circulating this fluid continuously back to surface via the drilled space between the hole/tubular, (generally referred to as the annulus). The drillstring is comprised of sections of tubular joints connected end to end, and their respective outside diameter depends on the geometry of the hole being drilled and their effect on the fluid hydraulics in the wellbore.

Mud is pumped down the drill string using mud pumps—typically positive displacement pumps, the output of which is connected to the drill string via a manifold. For a subsea well bore, a tubular, known as a riser extends from the rig to the top of the wellbore which exists at subsea level on the ocean floor. It provides a continuous pathway for the drill string and the fluids emanating from the well bore. In effect, the riser extends the wellbore from the sea bed to the rig, and the annulus also comprises the annular space between the outer diameter of the drill string and the riser.

Where the drilling is carried out by rotating the drill bit from surface, the entire drillstring and bit are rotated using a rotary table, or using an above ground motor mounted on the top of the drill pipe known as a top drive. The bit can also be turned independently of the drillstring by a drilling fluid powered downhole motor, integrated into the drillstring just above the bit. Bit types vary and have different designs in their profile in regards to items such as cutter design and profile, and their selection is based on the formation type being drilled.

As drilling progresses it is necessary to connect a new section of pipe to the existing drillstring to drill deeper. Conventionally, this involves shutting down fluid circulation completely so the pipe can be connected into place as the top drive has to be disengaged.

The large diameter sections that exist at the end of each section of drillpipe are referred to as tool joints. During a connection, these areas provide a low stress area where rig pipe tongs or an Iron Roughneck can be placed to grip the pipe and apply torque to either make or break a connection.

Conventionally, the well bore is open to atmospheric pressure and there is no surface applied pressure or other pressure existing in the system. The drillpipe rotates freely without any sealing elements imposed or acting on the drill pipe at the surface because there is no requirement to divert the return fluid flow or exert pressure on the system during standard operations.

The bit penetrates its way through layers of underground formations until it reaches target prospects—rocks which contain hydrocarbons at a given temperature and pressure. These hydrocarbons are contained within the pore space of the rock (i.e. the void space) and can contain water, oil, and gas constituents—referred to as reservoirs. Due to overburden forces from layers of rock above, these reservoir fluids are contained and trapped within the pore space at a known or unknown pressure, referred to as pore pressure. An unplanned inflow of these reservoir fluids is well known in the art, and is referred to as a formation influx or kick.

The use of blow out preventers, referred to as BOPs, to seal and control the formation influxes in the wellbore are well known in the art, and are compulsory pressure safety equipment used on both land and off-shore rigs. Whilst land and subsea BOPs are generally secured to a well head at the top of a wellbore, BOPs on off-shore rigs are generally mounted below the rig deck, integrated into the riser on the ocean floor.

In an "annular BOP", elements seal around the drill string, thus closing the annulus and stopping flow of fluid from the wellbore. They typically include a large flexible annular rubber or elastomer packing unit configured to seal around a variety of drillstring sizes when activated, and are not designed to be actuated during drillstring rotation as this would rapidly wear out the sealing element. A pressurized hydraulic fluid and piston assembly are used to provide the necessary closing pressure of the sealing element. These are well known in the art.

Managed pressure drilling and/or underbalanced drilling utilizes additional special equipment that has been developed to keep the well closed at all times, as the wellhead pressures in these cases are non-atmospheric, as in the traditional art of the conventional overbalanced drilling method.

The present invention is, however, intended for use in an operating system with a well having a drilling fluid circulating within a closed loop system. The closed loop is generated by a rotating pressure containment device (RPCD) which forms a pressure seal around the drillpipe at surface at all times. This device could be a rotating control head (RCD or RCH), rotating blow out preventer (RBOP), or pressure control while drilling (PCWD). The RPCD is designed to allow the drill string and its tool joints to pass through with either reciprocation/stripping or rotation, and to direct returning drilling fluid from the annulus is diverted to a return flow line.

With drilling activity in progress and the RPCD closed, a back pressure is created in the well. The drill string is stripped or rotated through the sealing element (s) of the RPCD which isolates the annulus from the external atmosphere while maintaining a pressure seal around the drill string. RPCDs are standard equipment and many designs are commercially available or readily adaptable from existing designs on the market and are well known in the art.

Underbalanced drilling (UBD) allows the flow of commingled drilling and reservoir fluids to surface during drilling and tripping, and therefore a pressurized annulus containing hydrocarbons, solids, and drilling fluids exists below the pressure seal of the RPCD. Managed pressure drilling (MPD) utilizes back pressure on the annulus during drilling to provide the necessary equivalent hydrostatic pressure to prevent the formation influx from entering the well bore. Both methods result in a pressurized annulus containing drilling fluids, and/or solids, and/or formation fluids below the seal of the RPCD. In either case, a sealing element exists within the housing of the RPCD, the sealing element being in direct contact with the drill pipe and providing the necessary annular isolation and pressure integrity for safe drilling.

Complexity increases when MPD or UBD operations are applied offshore, and specifically the deeper the water the more difficult these operations become. The riser section from the seabed floor to the drilling platform becomes an extension of the wellbore, with the well control BOP, referred to as the subsea BOP, situated on the ocean floor. Formation pressures in these situations may be extraordinarily high and extreme underbalanced conditions are undesired because of the high risks involved when a formation influx is in the riser system. Therefore offshore. MPD operations are becoming more important for mitigating these risks and increasing the overall safety of the drilling platform. A riser sealing solution for MPD allows enhanced pressure control over the riser and a safe diversion of formation influx (if it occurs) through a discharge/control manifold.

There are existing riser sealing systems in use, but many carry deficiencies that result in costly rig up and deployment time, and excessive non-productive time for replacement upon failure in operations. There are some systems that require the upper section of the riser—such as slip joints—to be removed as these components cannot withstand the elevated pressures of MPD operations. A riser seal assembly, in the form of an RCD, RBOP, or PCWD is installed and operations proceed with the exposed drillstring engaging the assembly and extending downwards into the riser. Switching from MPD to non-MPD type operations requires a significant amount of time to remove the assembly and install the upper riser sections for conventional drilling. Reverting from one to the other equates to substantial costs in the operation.

There are other systems that enable both MPD and non-MPD operations to be achieved through one riser assembly. Although these are an improvement in regards to reducing the complicated rig up and tear down operations on the riser, deficiencies in their engineering designs and sealing mechanisms still remain.

A typical RPCD includes an elastomer or rubber packing/sealing element and a bearing assembly that allows the sealing element to rotate along with the drillstring. There is no rotational movement between the drillstring and the sealing element—only the bearing assembly exhibits the rotational movement during drilling. These are well known in the art and are described in detail in patent numbers U.S. Pat. Nos. 7,699,109, 7,926,560, and 6,129,152.

The pressure seal provided with conventional RPCD designs is achieved using active and/or passive methods.

Passive sealing is accomplished by the exertion from the wellbore pressure below against the lower part of the sealing element exposed to the annulus which forces the element inwards against the drillpipe external surface. Passive seals are well known in the art and are described in U.S. Pat. No. 7,040,394.

Active seals are usually provided by the use of a hydraulic network system, circuitry, and bladder. A hydraulic circuit provides fluid to the RPCD and a high pressure hydraulic pump within the circuit is used to energize the active seal arrangement. The pressure chamber for activating the bladder is preferably defined within the rotating seal assembly, and the rotating seal assembly includes both the bladder and the bearings. The rotating seal assembly is hydraulically secured within the RPCD housing, usually by remote control and performed by a single cylindrical latch piston. Active seals are well known in the art, and disclosed, for example, in patent numbers U.S. Pat. Nos. 7,380,590 and 7,040,394.

When the sealing element fails or requires replacement, the seal assembly is unlatched and the rotating seal assembly is lifted from the RPCD by a combination of the rig winch line and/or tool joint by stripping upwards with the drillstring to change out the bearing and/or element. The procedure is inefficient and time intensive, and requires personnel to go beneath the drilling platform to manually release the bearing and sealing assembly in the rotating head. Later designs (such as that disclosed in WO 2011/093714) have allowed for an internal riser retrieval procedure so that riser equipment above the RPCD does not have to be removed.

Therefore it is important to engineer and design a sealing element to provide pressure integrity around the drillpipe with materials that can withstand the harsh environments below the RPCD, and the wear and tear from axial forces of the drillpipe body and larger diameter tool joints passing through the element with rotation and/or vertical motion.

RPCD sealing elements are a solid body typically comprised of dense flexible materials, such as elastomers, and are normally a single or dual element configuration within the housing. The materials used as such are not robust such that high friction coefficients and low wear resistance result. There are continuously growing challenges for improvements in the durability and life of sealing assemblies. Such designs are described in more detail in U.S. Pat. No. 4,361,185.

Drillpipe rotation and vertical movement wears out the sealing elements, and the passage of tool joints and larger OD tubulars causes the sealing element to expand and contract multiple times. Replacement requires the drilling operation to stop and therefore lowers the well performance, and the replacement frequency for sealing assemblies varies with wellbore pressure, temperature, fluid composition, and stripping/rotating frequency over the drilling phase. Therefore an increased longevity of the sealing element will result in a more efficient operation and increased productivity time on the drilling platform. There wear/friction coefficients present with elastomeric materials used in element design are too high and greatly affect their operational life. There has been little technological advancement in the field of material composites/compounds used in sealing element engineering and design.

In yet another more recent design of an RCD element by SIEMWIS, new composite and thermoplastic/elastomeric materials are used in successive sets of sealing elements. An additional floating liquid seal of grease, referred to as a hydrodynamic film or floating grease seal, is injected between the tubular-elastomer interface to provide the lubrication and effective seal around the drillpipe or tubular. The well pressure in combination with the grease produces the seal while lubricating the elements, and performs this function by stepping down the well pressure through each successive set of elements in its configuration. This design is outperforming current element designs by extending the passive seal operational life by approximately 10 times while stripping and 3-4 times while rotating. The element design and sealing mechanism can be referred to in detail in patent applications WO 2009/017418A1, WO2008/133523A1, and WO2007/008085A1.

It is an object of the present invention to provide a sealing assembly for use in a RPCD with improved longevity relative to existing designs.

According to a first aspect of the invention we provide a pressure containment device for sealing around a tubular body, the pressure containment device comprising an actuator assembly and a seal assembly, the actuator assembly being operable to engage with the seal assembly to prevent significant rotation of the seal assembly with respect to the actuator assembly and to force the seal assembly into sealing engagement with a tubular body mounted in the pressure containment device, the seal assembly comprising a tubular seal sleeve having a radially inward portion made from a non-elastomeric polymer, and a radially outward portion made from an elastomer.

The invention provides a dynamic/active sealing mechanism with a non-elastomeric seal which will seal on any tubular OD which passes through the sealing element, and is an active sealing bearing-less (i.e. no bearing assembly present in the design) assembly. By virtue of the use a non-elastomeric polymer as the radially inward portion of the seal sleeve, the wear properties of the seal assembly may be improved and the frictional forces between the seal assembly and the tubular body reduced.

In one embodiment, the actuator assembly includes an annular packing unit and an actuator operable to reduce the internal diameter of the annular packing unit.

In this case, advantageously, the seal sleeve is in use positioned generally centrally of the packing unit so that the packing unit surrounds at least a portion of the seal sleeve.

In one embodiment, the actuator comprises a piston movable generally parallel to a longitudinal axis of the pressure containment device by the supply of pressurised fluid to the pressure containment device.

The radially inward portion of the seal sleeve may be made from one of polytetrafluoroethylene (PTFE) or Teflon™, a PTFE-based polymer or ultra-high molecular weight polyethylene (UHMWPE).

The radially inward portion of the seal sleeve may contain additives or fillers. These may comprise at least one of fibreglass, molybdenum disulphide, tungsten disulphide or graphite. By virtue of the use of such additives or fillers, the wear resistance and/or thermal conductivity of the seal sleeve may be improved.

The radially outward portion of the seal sleeve may be made from one of polyurethane or hydrogenated nitrile butadiene rubber.

In one embodiment, the radially inward portion of the seal sleeve contains a plurality of apertures. In this case, parts of the radially outward portion of the seal sleeve may extend into the apertures of the radially inward portion.

By virtue of the use of an engineered design and structure for the radially inward portion of the seal sleeve (utilizing, for example, a hatched, honeycomb, or mesh pattern), the seal sleeve may be provided with the necessary flex and the required strength that will satisfy the stress-strain ratios resulting from the range in outer diameters of the tool joint and drillpipe body to pass without failure.

In one embodiment, the pressure containment device further comprises a second actuator assembly and seal assembly, the second actuator assembly being operable to engage with the second seal assembly to prevent significant rotation of the second seal assembly with respect to the second actuator assembly and to force the second seal assembly into sealing engagement with a tubular body mounted in the pressure containment device, the second seal assembly also comprising a tubular seal sleeve having a radially inward portion made from a non-elastomeric polymer, and a radially outward portion made from an elastomer. In this case, the pressure containment device may further comprise means to direct lubricating fluid to the region around the tubular body between the first and second seal assemblies.

The invention can thus use a simple inexpensive fluid, such as but not limited to, drilling fluid, to lubricate the contact area between the tubular and the sealing face of the invention.

The present containment device may be a blowout preventer.

According to a second aspect of the invention we provide a method of containing pressure in a well bore, a tubular body extending into the well bore, the method comprising mounting a pressure containment device around the tubular body, the pressure containment device comprising an actuator assembly and a seal assembly, the seal assembly comprising a tubular seal sleeve having a radially inward portion made from a non-elastomeric polymer, and a radially outward portion made from an elastomer, wherein the method comprises operating the actuator assembly to engage with the seal assembly to prevent significant rotation of the seal assembly with respect to the actuator assembly and to force the radially inward portion of the seal sleeve into sealing engagement with the tubular body.

The step of operating the actuator assembly may comprise the supply pressurised fluid to the pressure containment device.

The method may further comprise varying the force exerted on the tubular body by the seal sleeve by varying the pressure of fluid supplied to the actuator assembly.

The invention thus provides a method to vary the contact area of the sealing element-tubular interface by regulating the hydraulic pressure of the active/dynamic seal.

The invention advantageously provide the necessary annular clearance to drift a tubular or drillpipe tool joint when the hydraulic circuit pressure that energizes the sealing mechanism is not applied. In other words, when the actuator assembly is not operated to force the seal assembly into engagement with the tubular body, the seal sleeve will relax/retract to allow the passing of a drillpipe tool joint without any contact between the tool joint and seal sleeve occurring. There may or may not be minimal contact with larger tubular profiles, but the contact pressure will be low with the seal assembly deactivated so this will not be damaging.

The invention may or may not require a small film of fluid/liquid for the effective pressure seal and lubrication. The non-elastomeric polymer will result in low enough friction factors that a floating fluid seal or hydrodynamic seal may/may not be needed.

Figure 2:
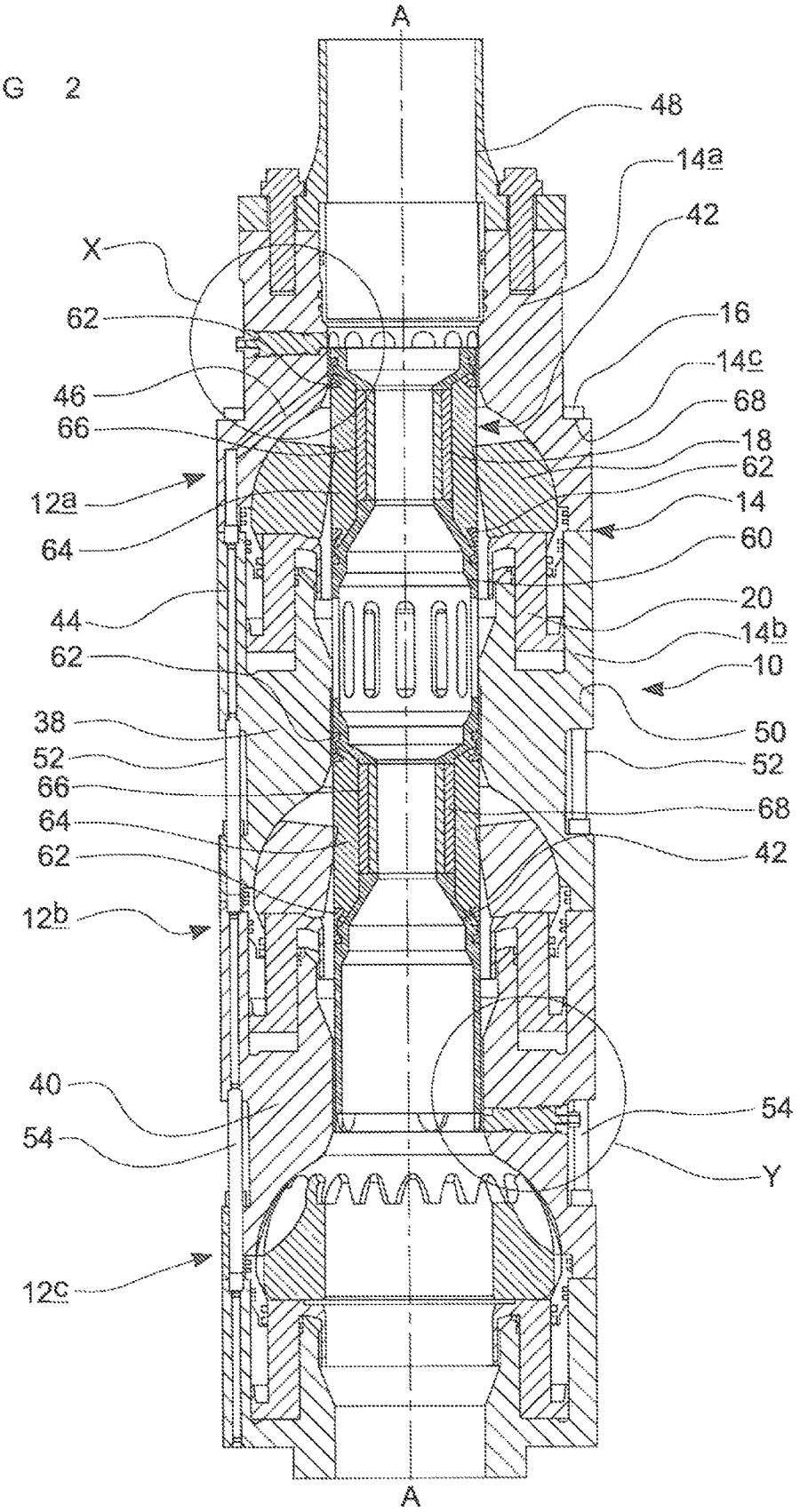
Figure 3:
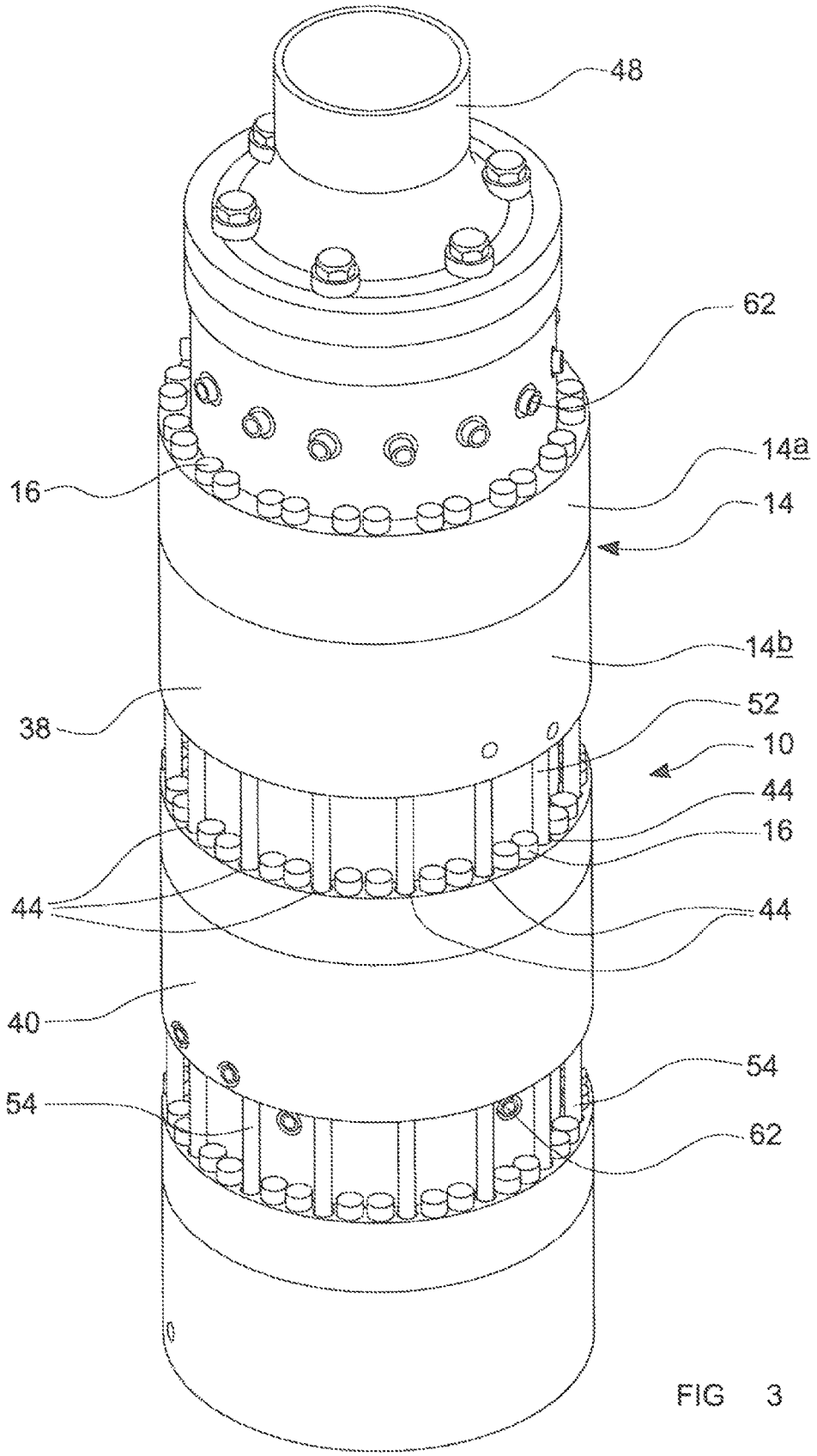
Figure 4:
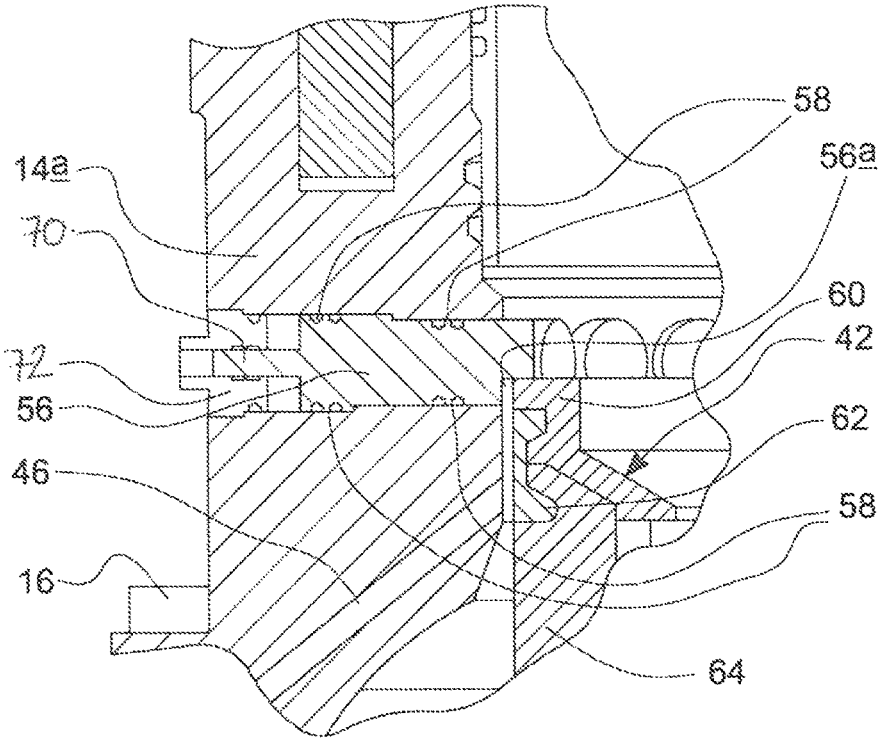
Figure 5:
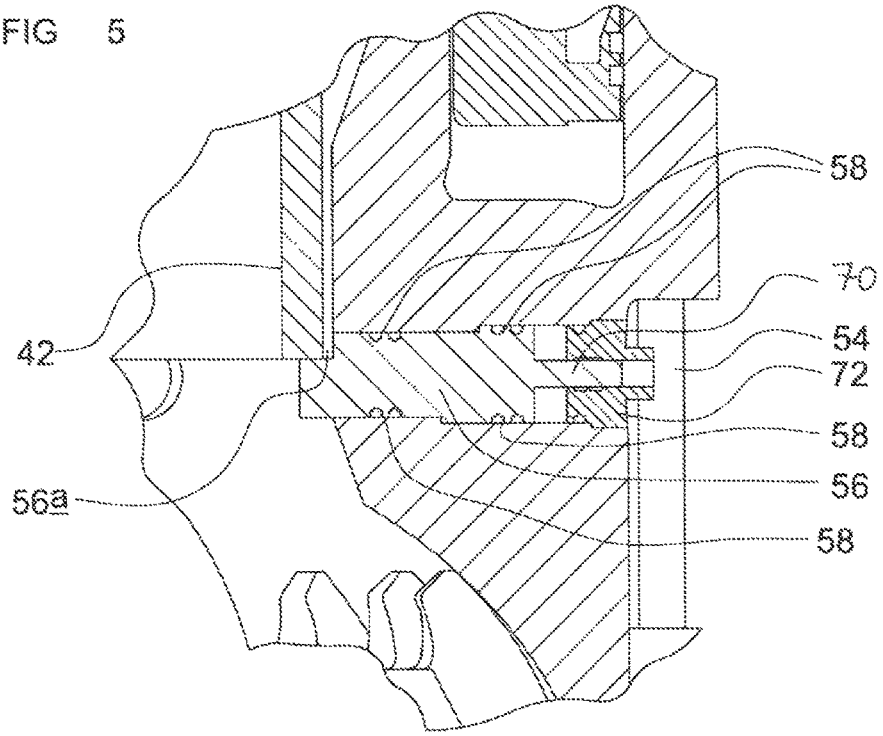
Figure 6:
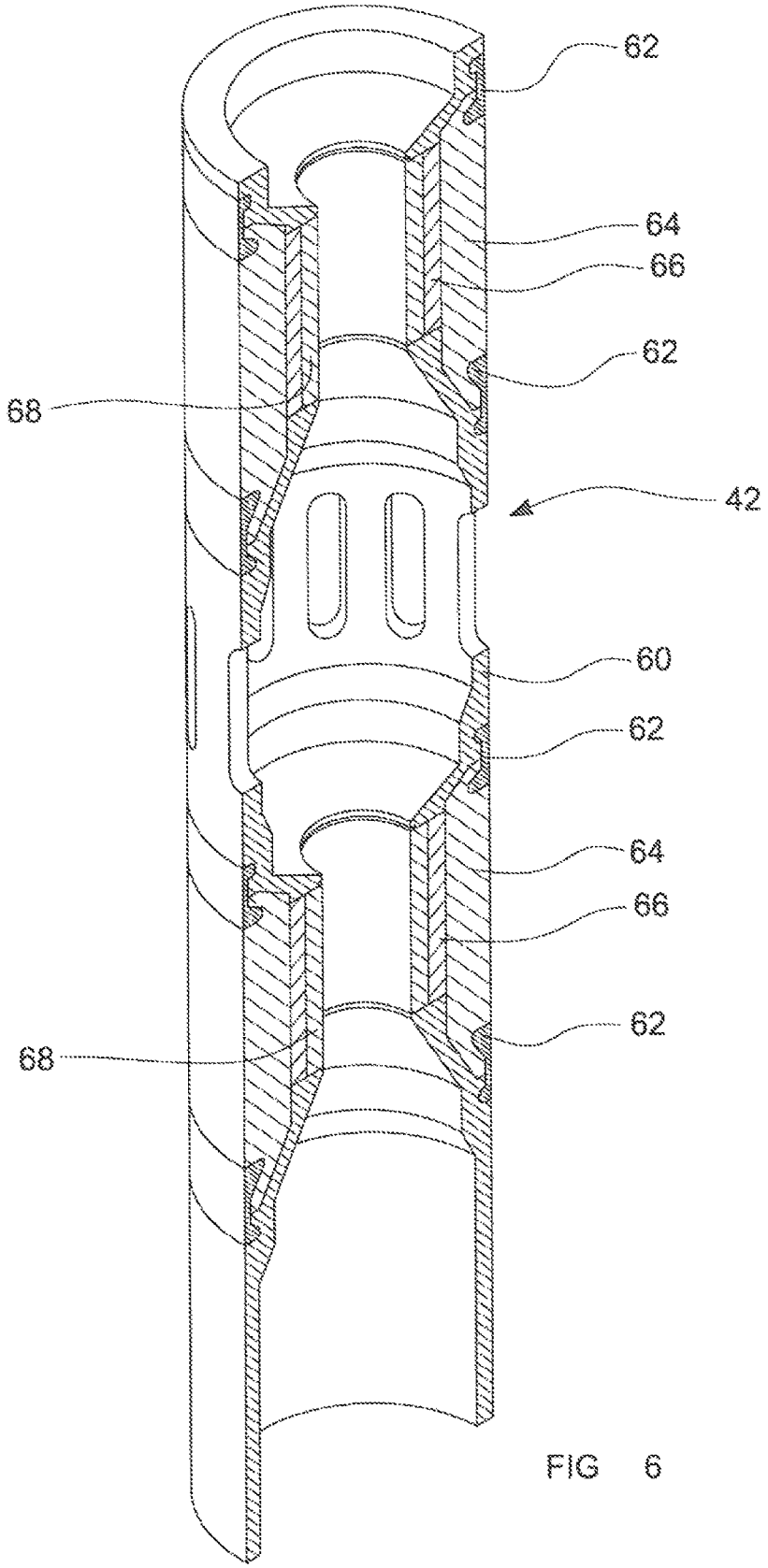
Figure 7:
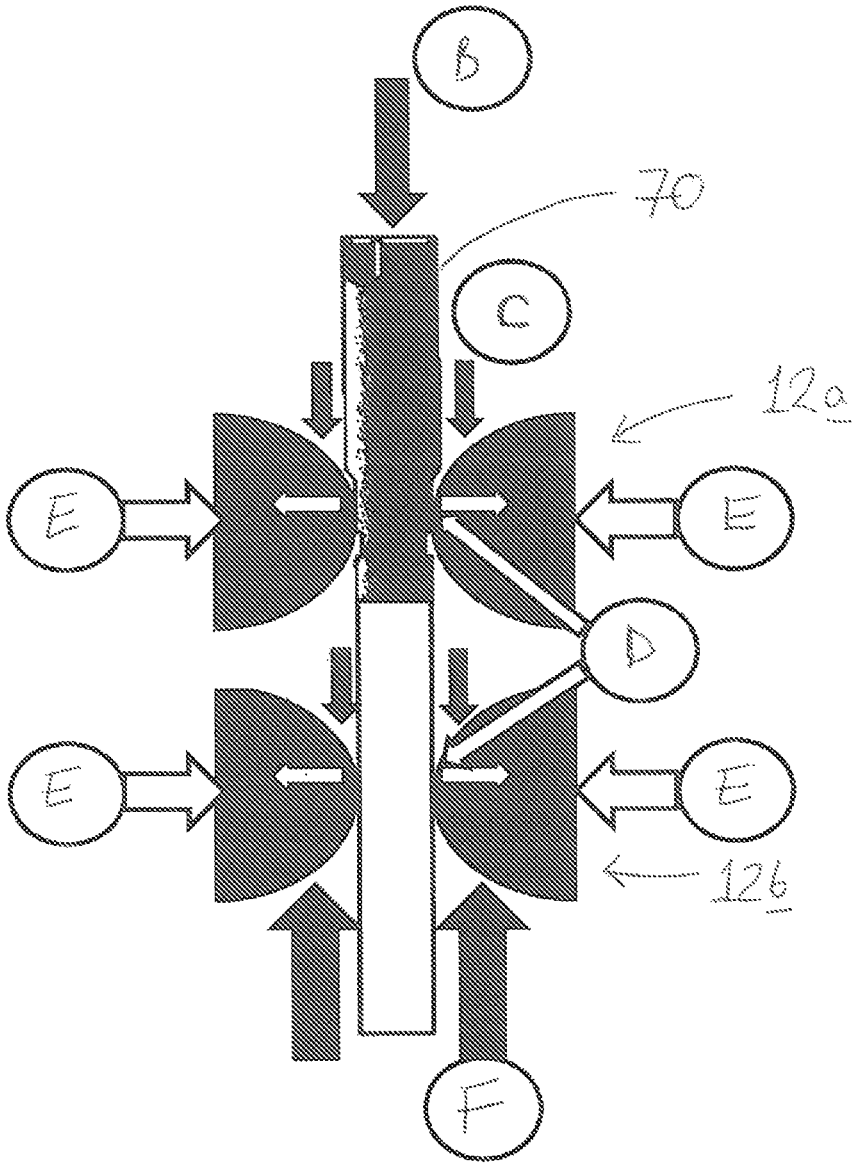

Embodiments of the invention will be described below, by way of example only, with reference to the following drawings:

FIG. 1 is a longitudinal cross-section through the housing and actuating parts of a rotating pressure containment device (RPCD) in accordance with the invention, FIG. 2 is a longitudinal cross-section through an RPCD (including the seal assembly) in accordance with the invention, FIG. 3 is a perspective side view of the RPCD illustrated in FIGS. 1 and 2, FIG. 4 is a detailed view of the portion of the cross-section through the RPCD marked X in FIG. 1, FIG. 5 is a detailed view of the portion of the cross-section marked Y in FIG. 1, FIG. 6 is a perspective view of a cross-section through the seal assembly shown in FIG. 2, FIG. 7 shows a schematic illustration of the forces acting on various parts of the RPCD shown in FIGS. 1, 2 and 3, FIG. 8 shows an example of the polymeric sealing element used in the seal assembly shown in FIGS. 2 and 6, including a) a perspective view, b) a side view, and c) a longitudinal cross-section Referring now to FIG. 1, there is shown a RPCD 10, which in this example comprises a stack of three pressure containment devices 12*a*, 12*b*, 12*c*. In this example, each of the pressure containment devices is an annular BOP, the internal working parts of which are based on the original Shaffer annular BOP design set out in U.S. Pat. No. 2,609,836. It should be appreciated, however, that the invention does not reside in the internal working parts of the BOP, and therefore may be applied to any other design of BOP, or indeed other configurations of pressure containment device. It should also be appreciated that in this example, each BOP 12*a*, 12*b*, 12*c* in the stack is substantially identical to the others, and, for clarity the reference numerals used in the description below have been shown in the accompanying figures only in relation to the uppermost BOP 12*a* in the RCPD 10. The same parts, are, however, included in each of the BOPs 12*a*, 12*b*, 12*c*. The BOPs 12*a*, 12*b*, 12*c* need not all be of the same configuration, of course, and the RPCD 10 could include more than or fewer than three BOPs.

It should be appreciated that the RPCD 10 according to the invention may be used to seal around tubular bodies in any liquid and/or gas carrying wellbore, and installed in any subsea BOP riser configuration or land based BOP on an installation, vessel, or land operation.

Each BOP 12*a*, 12*b*, 12*c* comprises a housing 14 which is divided into a first part 14*a* and a second part 14*b* which are fastened together using a plurality of fasteners 16. Whilst a convention stud and nut connection could be used, in this example, large cap head screws or bolts are used. The exterior surface of each housing part 14*a*, 14*b* is generally cylindrical, as illustrated best in FIG. 3. The first housing part 14*a* is, however, provided with a shoulder 14*c* which extends generally perpendicular to the longitudinal axis A of the BOP 12*a*, 12*b*, 12*c* between a smaller outer diameter portion and a larger outer diameter portion, the larger outer diameter portion being between the smaller outer diameter portion and the second part 14*b* of the housing 14. The outer diameter of the second part 14*b* of the housing 14 is approximately the same as the outer diameter of the larger outer diameter portion of the first part 14*a* of the housing 14.

A plurality of generally cylindrical fastener receiving passages ("bolt holes") are provided in the housing 14, and in this embodiment of the invention, these extend generally parallel to the longitudinal axis A of the BOP 12*a* from the shoulder 14*c* through the larger outer diameter portion of the first part 14*a* of the housing 14 into the outer wall 28 of the second part 14*b* of the housing 14. Preferably the portion of each bolt hole in the second part 14*b* of the housing 14 is threaded, so that the two parts 14*a*, 14*b* of the housing 14 may be secured together by passing a bolt 16 through each of these bolt holes so that a threaded shank of each bolt 16 engages with the threaded portion of the bolt hole whilst a head of the bolt 16 engages with the shoulder 14*c*.

In order to ensure that the housing 14 is substantially fluid tight, in a preferred embodiment of the invention, a sealing device is provided between the first part 14*a* and the second part 14*b* of the housing 14. This sealing device may comprise an O-ring or the like located between the adjacent end faces of the two parts 14*a*, 14*b* of the housing 14, the end faces extending generally perpendicular to the longitudinal axis of the BOP 12*a*. This means that the sealing device is crushed between the two parts 14*a*, 14*b* of the housing 14 as the bolts 16 are tightened. This could result in damage to the sealing device. As such, in the examples illustrated in FIGS. 1 and 2, the sealing device comprises a sealing ring 32 which engages with the interior face of the housing 14, extending between the first and second parts 14*a*, 14*b*. By locating the seal device in this position, the sealing device is not subjected to loading from the bolts 16 as the bolts 16 are tightened.

In addition to the bolt holes, there are further passages (fluid flow passages) which extend generally parallel to the longitudinal axis A of the BOP 12*a* through one or both of the larger outer diameter portion of the first part 14*a* of the housing 14 and the outer wall 28 of the second part 14*b* of the housing 14. These passages provide conduits for directing fluids, such as lubricant or drilling mud scavenging fluid to selected positions within the housing 14. One such fluid flow passage 44 is illustrated in FIGS. 1 and 2, and the upper end of the passage 44 within the larger outer diameter portion of the first housing part 14*a* is connected to the interior of the housing 14 above the annular packing element 18 by a further, diagonally extending passage 46. In order to accommodate the fluid flow passages 44 and the bolt holes in the housing 14 whilst minimising the outer diameter of the BOP 12*a*, the fluid flow passages are interspersed between the bolt holes. In this embodiment of the invention, the fluid flow passages and bolt holes lie in a generally circular array around the housing 14 with the longitudinal axes of each being substantially equidistant from the longitudinal axis A of the RPCD 10.

In the examples shown in the Figures, there are forty five longitudinal passages extending through the housing 14 as described above—thirty are bolt holes, and fifteen are fluid flow passages 44. These are arranged so that there are always two directly adjacent bolt holes, each pair of bolt holes being separated by a hydraulic passage 44. This is best illustrated in FIG. 3.

In another embodiment of the invention, there are forty eight longitudinal passages—thirty six bolt holes and twelve fluid flow passages, again arranged in a generally circular array centred around the longitudinal axis A of the RPCD 10. In this embodiment, preferably there are three bolt holes between adjacent fluid flow passages. Whilst in the embodiment of the invention shown in the figures, the longitudinal axes of the bolt holes and fluid flow passages 44 are generally evenly spaced around the housing 14, this need not be the case. It may be desirable to provide more space around each bolt hole, for example to accommodate the head of the fastener being place in the bolt hole and/or to provide sufficient room for a tool to be used to tighten the fasteners. It may also be desirable to increase the diameter of each bolt hole relative to the fluid flow passages 44 so as to accommodate larger diameter bolts.

An annular packing element 18 is housed in the first part 14*a* of the housing 14, and a hydraulic actuating piston 20 is housed in the second part 14*b* of housing 14. Circular axial ports 22, 24 are provided in the first 14*a* and second 14*b* parts of the housing 14 respectively, the first part 14*a* of the housing 14 including an enlarged cylindrical bore 26 which includes a curved, preferably hemispherical, cam surface which extends from the port 22 to the second part 14*b* of the housing 14.

The second part 14*b* of the housing 14 includes a generally cylindrical outer wall 28, and a generally coaxial, cylindrical inner wall 30, connected by a base part 31. The piston 20 is located in the annular space between the outer wall 28 and the inner wall 30, sealing devices (such as one or more O-rings) are provided between the piston 20 and each of the outer wall 28 and inner wall 30 so that the piston 20 divides this annular space into two chambers, and prevents any substantial leakage of fluid round the piston 20 from one chamber to the other.

In this example, the piston 20 has a generally cylindrical body 20*a* which engages with or is very close to the inner wall 30 but which is spaced from the outer wall 28. At a lowermost end of the piston 20 (the end which is furthest from the packing element 18), there is provided a sealing part 20*b* which extends between the outer wall 28 and the inner wall 30, there being sealing devices between the sealing part 20*b* and both the outer wall 28 and inner wall 30. The sealing ring 32 is also in sealing engagement with the uppermost end of the piston 20 (the end which is closest to the packing element 18). A first fluid tight chamber 34 is therefore formed between the outer wall 28, inner wall 30, base part 31 and the sealing part 20*b* of the piston 20*b*, and a second fluid tight chamber 36 is formed between the outer wall 28, the sealing device 32 and the sealing part 20*b* and the body 20*a* of the piston 20.

The piston 20 is movable between a rest position in which the volume of the first chamber 34 is minimum, and an active position in which the uppermost end of the piston 20 extends into the first part 14*a* of the housing 14.

A first control passage (not shown) is provided through the second part 14*b* of the housing 14 to connect the first chamber 34 with the exterior of the housing 14, and a second control passage (not shown) is provided through the second part 14*b* of the housing 14 to connect the second chamber 36 with the exterior of the housing 14. The piston 20 may thus be moved to the active position towards the packing element 18 by the supply of pressurised fluid through the first passage, and to the rest position away from the packing element 18 by the supply of pressurised fluid through the second passage. Advantageously, at least a substantial portion of each of these control passages is one of the fluid flow passages described above.

The piston 18 is arranged such that when it is in the rest position, it does not exert any forces on the packing element 18, whereas when it is in the active position, it pushes the packing element 18 against the cam surface. The packing element 18 is made from an elastomeric material, typically polyurethane or hydrogenated nitrile butadiene rubber, and may include metallic inserts or ribs to assist in maintaining its structural integrity. The action of the piston 20 forcing it against the cam surface causes the packing element 18 to be compressed, and to constrict, like a sphincter, reducing the diameter of its central aperture.

In this example, the RPCD 10 comprises three BOPs 12*a*, 12*b*, 12*c*, which are co-axially aligned about a single longitudinal axis A. The second part 14*b* of the housing 14 of the top BOP 12*a* is integrally formed with the first part of the housing of the middle BOP 12*b* (thus forming a first combined housing part 38), and the second part of the housing of the middle BOP 12*b* is integrally formed with the first part of the housing of the bottom BOP 12*c* (thus forming a second combined housing part 40). The housings of each BOP 12*a*, 12*b*, 12*c* thus form a continuous central passage which extends along the longitudinal axis A of the RPCD 10. In use, the RPCD 10 may be mounted in a riser with the first part 14*a* of the housing 14 of the uppermost BOP 12*a* being secured, by conventional means, to an upper portion of riser 48, and the second part 14*b* of the housing of the lowermost BOP 12*c* being secured, by conventional means, to a lower portion of riser (not shown).

It should be appreciated that this integration of housing parts means that there are two shoulders in the exterior surface of the combined housing part 38, 40, the first of which extends generally perpendicular to the longitudinal axis A of the RPCD 10 between the second part 14*b* of the upper BOP 12*a*, 12*b* and the smaller diameter portion of the first part 14*a* of the lower BOP 12*b*, 12*c*, and the second of which extends generally perpendicular to the longitudinal axis A of the RPCD 10 between the smaller diameter portion and the larger diameter portion of the first part 148 of the lower BOP 12*b*, 12*c*.

The bolt holes for connecting the first combined housing part 38 to the second combined housing part 40 extend from the second shoulder in the first combined housing part 38 and into the outer wall of the second housing part of the middle BOP 12*b*. The bolt holes for connecting the second combined housing part 40 to the second housing part of the lowermost BOP 12*c* extend from the second shoulder in the second combined housing part 40 and into the outer wall of the second housing part of the lowermost BOP 12*c*. The heads of the bolts 16 thus engage with the second shoulder on each of the combined housing parts 38, 40.

In order to extend the hydraulic passages 44 along the entire length of the RPCD 10, hydraulic connector pipes 52 are provided. Each hydraulic passage 44 in the housing 14 of the uppermost BOP 12*a* extends through to the first shoulder of the first combined housing part 28 where it joins a first hydraulic connector pipe 52. The first hydraulic connector pipe 52 extends through the hydraulic passage provided in the first part of the housing of the middle BOP 12*b* where it connects with a hydraulic passage in the second part of the housing of the middle BOP 12*b*. The hydraulic passage then emerges at the first shoulder of the second combined housing part 40 where it joins with a second hydraulic connector pipe 54. The second hydraulic connector pipe 54 extends through the hydraulic passage provided in the first part of the housing of the lowermost BOP 12*c* where it connects with a hydraulic passage in the second part of the housing of the lowermost BOP 12*c*. The hydraulic passage then emerges from the lowermost transverse face of the housing 14 of the lowermost BOP 12 as illustrated best in FIG. 6.

All external hydraulic connections to the interior of the RPCD 10 may thus be made via the lowermost transverse face of the RPCD 10, thus ensuring that the hydraulic connections need not increase the outer diameter of the RPCD 10.

The hydraulic connector pipes 52 are sealed to the housing 14 by means of stingers including seals such as O-rings, and are held captive once the BOP stack is assembled. To achieve this, each first hydraulic connector pipe 52 is inserted through the hydraulic passage in the first part of the housing of the middle BOP 12*b* and brought into sealing engagement with the hydraulic passage in the second part 14*b* of the housing 14 of the uppermost BOP 12*a* at the first shoulder 50 in the first combined housing part 38. The first combined housing part 38 may then be bolted to the second combined housing part 40. Similarly, each second hydraulic connector pipe 54 is inserted through the hydraulic passage in the first part of the housing of the lowermost BOP 12*b* and brought into sealing engagement with the hydraulic passage in the second part of the housing of the middle BOP 12*b* at the first shoulder 50 in the second combined housing part 40. The second combined housing part 40 may then be bolted to the second housing part of the lowermost BOP 12*c*.

Referring now to FIG. 2, this shows the RPCD 10 with a seal assembly 42 located in the central passage of the RPCD 10. The seal assembly 42, which is illustrated in detail in FIG. 6, comprises a support framework 60, which is formed in three parts which are, in a preferred embodiment of the invention, fabricated from a steel. The first part 60*a* is uppermost when the seal assembly 42 is in use, mounted in the RPCD 10 as shown in FIG. 2, and comprises an annular collar with a lip extended radially inwardly from the lowermost end of the collar, the lip being inclined towards the lowermost end of the sealing assembly at an angle of around 45° to the longitudinal axis A of the RPCD 10. The inclined lip has at its radially inward edge an edge portion with a surface which lies in a plane generally normal to the longitudinal axis A of the RPCD 10 and which faces the second part 60*b* of the support frame 60.

The second part 60*b* is below the first part 60*a* and comprises a tubular wall with a generally circular cross-section, having at both its uppermost and lowermost ends a radially inwardly extending lip. Both lips are inclined at an angle of around 45° to the longitudinal axis A of the RPCD 10 away from the tubular wall. The uppermost lip is therefore inclined towards the first part 60*a* of the support frame, whilst the lowermost lip is inclined towards a third, lowermost, part 60*c* of the support frame 60. The inclined lips at the uppermost and lowermost ends of the second part 60*b* have at their radially inward edge an edge portion with a surface which lies in a plane generally normal to the longitudinal axis A of the RPCD 10 and which face the first part 60*b* of the support frame 60, and the third part 60*c* of the support frame 60 respectively.

The lowermost part 60*c* of the support frame 60 also comprises a tubular wall which a generally circular transverse cross-section, with a radially inwardly extending lip at its uppermost end. The lip is also inclined at around 45° to the longitudinal axis A of the RPCD 10 away from the tubular wall and towards the second part 60*b* of the support frame 60. The inclined lip also has at its radially inward edge an edge portion with a surface which lies in a plane generally normal to the longitudinal axis A of the RPCD 10 and faces towards the second part 60*b* of the support frame.

Between the first and second parts of the support frame 60 is located a seal sleeve which in this embodiment of the invention comprises a seal packing element 64, and a seal, in this example comprising a first sealing element 66 and a second sealing element 68. The seal packing element 64 and the sealing elements 66, 68 together form a tube with a generally circular transverse cross-section. The seal packing element 64 forms the radially outermost surface of the tube, the second sealing element 68 forms the radially innermost surface of the tube, with the first sealing element 66 being sandwiched between the two. The length of the seal packing element 64 increases from its radially innermost portion to its radially outermost portion, with the seal elements 66, 68 being just slightly shorter than the radially innermost portion of the seal packing element 64. The ends of seal packing element 64 thus engage with the inclined face of the adjacent lips of the first and second parts of the support frame, with the seal elements 66, 68 being sandwiched between the edge portions.

A substantially identical seal is provided between the second and third parts of the support frame 60.

Four assembly clamps 62 are provided, to connect the support frame to the seals, a first assembly clamp 62*a* connecting the first part 60*a* of the support frame 60 to the uppermost end of the uppermost seal, a second assembly clamp 62*b* connecting the uppermost end of the second part 60*b* of the support frame 60 to the lowermost end of the uppermost seal, a third assembly clamp 62*c* connecting the lowermost end of the second part 60*b* of the support frame 60 to the uppermost end of the lowermost seal, and a fourth assembly clamp 62*d* connecting the third part 60*c* of the support frame 60 to the lowermost end of the lowermost seal.

In this embodiment of the invention, each assembly clamp 62 is a ring with a C-shaped transverse cross-section. A first portion of the clamp 62 is located in a circumferential groove in the radially outermost face of the respective support frame 60 part whilst a second portion of the clamp 62 is located in a circumferential groove in the radially outermost face of the respective seal packing element 64, the clamp 62 thus spanning the join between the support frame 60 and the seal.

As shown in FIG. 2, the seal assembly 42 is located in the central bore of the RPCD 10, with the uppermost seal adjacent the packing element 18 of the uppermost BOP 12*a*, and the lowermost seal adjacent the packing element 18 of the middle BOP 12*b*, the first part of the support frame 60 engaging with the first part 14*a* of the housing 14 of the uppermost BOP 12*a*, the second part of the support frame 60 engaging with the first combined housing part 38, and the third part of the support frame 60 engaging with the second combined housing part 40.

When the pistons 20 of the uppermost BOP 12*a* and the middle BOP 12*b* move to the active position, the packing element 18 is compressed around and engages with the radially outermost surface of seal packing element 64. This compresses the seal, and, when a tubular body such as a drill string is present in the RPCD 10, causes each seal to close tight, like a sphincter, around the drill string.

As the force exerted by the piston 20 on the packing element 18 increases, the area of contact between the seal and the drill string (the sealing area) increases. The sealing area for each BOP 12*a*, 12*b* is thus proportional to the pressure of hydraulic fluid in the first chamber 34. It is also proportional to the contact force produced between the seal and the drill string, and so the fluid pressure applied to the piston 20 can be increased until the contact force is sufficient to overcome the forces exerted by pressurised fluid in the wellbore. Thus, when the RPCD 10 is mounted in a riser as described above, pistons 20 can be energised such that the engagement of the seal with the drill string, the packing elements 18 with the seal, and the packing elements 18 with the housing 14 can substantially prevent flow of fluid along the annular space between the BOP housing 14 and the drill string. The pressure of fluid in the well bore will exert a force on the sealing assembly tending to separate the seal from the drill string and the packing elements 18 from the seal, but, if the radially inwardly directed force exerted by the pistons 20 is sufficient to overcome this, the riser annulus will be closed by the movement of the piston 18 of either of the uppermost BOP 12*a* or middle BOP 12*b* to the active position.

The various forces acting within the RPCD 10 when in use to seal around a drill string 70 during drilling or tripping are illustrated schematically in FIG. 7. During drilling or tripping, the drill string 70 is stripped or rotated downwards through the RPCD 10. This movement is illustrated by arrow B, and the resulting downward compressive forces acting on the drill string by arrows C in FIG. 7. Each piston 20 and packing unit 18 combination exerts a radially inward force E on the seals as a result of hydraulic fluid pressure in the first chamber 34.

Fluid pressure in the wellbore creates an upward force F on the seal assembly, and this results in a radially outward force D acting on the seal, this force tending to push the seal assembly out of engagement with the drill string 70. If the hydraulic pressure in chamber 34 is sufficiently high for force E to be greater than force D, there will be an effective seal between the sealing assembly and the drill string 70 as discussed above. As a drill pipe tool joint enters the seal assembly 42, the relative increase in outer diameter of the drill string imposes an additional compressive force C and increases the radially outward force D on the seals. This force must be balanced by the forces E exerted by the packing unit 18 and piston 20 on the seals.

The active sealing method described above allows direct control over the contact pressure of the sealing element on the drillstring. The contact pressure of the seal assembly against the drillstring determines the wellbore pressure sealing capability, but also the wear rate of the seal itself. The contact pressure can be selected to optimise seal life by maintaining the optimum contact pressure for the conditions at the time. So, for example if the wellbore pressure is relatively low, the hydraulic pressure in the chamber 34 can be reduced to reduce the wear of the seal, but if the wellbore pressure increases, the hydraulic pressure in the chamber 34 can be increased to ensure the fluid in the wellbore is contained by the RPCD 10.

In this embodiment, the seal assembly 42 does not extend into the lowermost BOP 12*c* in the RPCD 10, so when activated by movement of the pistons 20 as described above, the packing element 18 of the lowermost BOP seals around the drill string without there being an intervening seal. As such, the lowermost BOP 12*c* is not technically part of the RPCD 10, in the sense that it is not designed to be closed around a drill string to provide pressure containment while the drill string is rotating. The lowermost BOP 12*c* may, however, be used as a safety closure device in the event that the other two BOPs 12*a*, 12*b* fail or leak.

When the seal elements 66, 68 in the seal assembly 42 wear out, the seal assembly 42 can be removed from the RPCD 10 and replaced with a new seal assembly, whilst the lowermost BOP maintains pressure in the annulus. It should also be noted that the packing element 18 in at least the lowermost BOP 12*c* can be activated to fully close the central bore of the RPCD 10 without there being a drill string or any other component in the central bore of the BOP stack. The same may be true either of the other two BOPs 12*a*, 12*b*, although in normal use, they would not be required to do this as the sealing assembly 42 is usually in place.

As discussed above, a drill string extending through the RPCD 10 may rotate relative to the RPCD 10 during drilling, and that there may also be translational movement of the drill string generally parallel to the longitudinal axis A of the RPCD 10, for example during stripping or tripping operations, or, where the drill string is suspended from a floating drilling rig, due to movement of the drilling rig with the swell of the ocean. When a seal is pushed into engagement with the drill string as described above, this relative movement will result in frictional forces between the seal and the drill string and consequent wear of the seal. The materials from which the seal elements 66, 68 are constructed are selected to reduce wear of the seal and heating effects due to frictional forces between the seal elements 66, 68 and the drill string.

In particular, in one embodiment, the second sealing element 68, which is in contact with the drill string, is a polymeric material selected to provide such properties whilst having the mechanical integrity to provide an effective seal. The polymeric sealing element 68 may be made from polytetrafluoroethylene (PTFE) or Teflon™, a PTFE based polymer or ultrahigh molecular weight polyethylene (UHMWPE). Additives or fillers such as fibreglass, molybdenum disulphide and/or tungsten disulphide may be included in the polymeric sealing element 68 to reduce the coefficient of friction and improve the wear resistance of the seal and therefore the operation life of the seal assembly 42. Moreover, in order to improve the conduction of heat arising from friction between the polymeric sealing element 68 and the drill string away from the contact surface (with the aim of reducing thermal degradation of the seal), the polymeric sealing element 68 may also include a thermally conductive filler—metallic or graphitic fibres or particles, for example.

To provide the seal with this necessary resilience to move out of engagement with the drill string when pressure from the packing elements 18 of the adjacent BOP 12*a*, 12*b* is released, in this example, there is a further seal element, namely the first seal element 66 which is made from an elastomeric material. The elastomeric sealing element 66 and seal packing element 64 may be made from polyurethane or hydrogenated nitrile butadiene rubber.

Whilst in the elastomeric sealing element 66 and the polymeric sealing element 68 may be fabricated as separate tubes and placed in mechanical engagement with one another, or they may be co-moulded to form a single part. In one embodiment of seal, the polymeric seal 68 includes a plurality of apertures (preferably radially extending apertures), and the elastomeric sealing element 66 (possibly together with the elastomeric seal packing element 64) is cast or moulded onto the polymeric seal 68 so that the elastomer extends into, and preferably substantially fills these apertures. The polymeric sealing element 68 may have a cross-hatched, mesh or honeycomb structure.

Fabricating the sealing elements 66, 68 in this way may be advantageous for three reasons. First, the provision of the apertures will increase the flexibility of the polymeric sealing element and allow the polymeric sealing element 68 to undergo sufficient elastic deformation to engage fully with a drill string when the piston 20 is activated, whilst springing back to its original shape to ensure that the seal assembly does not touch the drill string or a tool joint between adjacent sections of drill pipe, when the pressure on the piston 20 is released, i.e. when the seal assembly is not energized. The apertures may also assist in ensuring a sound connection between the elastomeric sealing element 66 and the polymeric sealing element. Finally, the apertures, even if filled with elastomeric material, may create pockets, which, when the seal assembly is under force/pressure can form reservoirs for lubricating fluid which may further assist in reducing frictional forces and wear of the seal assembly 42.

Filling the apertures with the elastomeric material assists in maintaining the structural integrity of the seal when under pressure, i.e. to assist in preventing the seal from collapsing under pressure.

The flexibility, yield strength and compressibility of the seals in the seal assembly may be altered by altering the relative proportions of the elastomeric and polymeric components, for example, by increasing the thickness of one relative to the other, or by increasing the volume fraction occupied by the apertures in the polymeric sealing element 68. Increasing the flexibility of the seal allows for easier staging or running of larger outer diameter tubular through the sealing assembly by allowing for larger outer diameter tool joints (relative to the outer diameter of the drill pipe body) to be passed through the sealing assembly without contacting the seal when the seal is deenergised. It should be appreciated, however, that the seal cannot be made so flexible that it cannot withstand the fluid pressures it will be exposed to in use without collapsing, so the yield strength and compressibility must be maintained at adequate levels.

Figure 8:
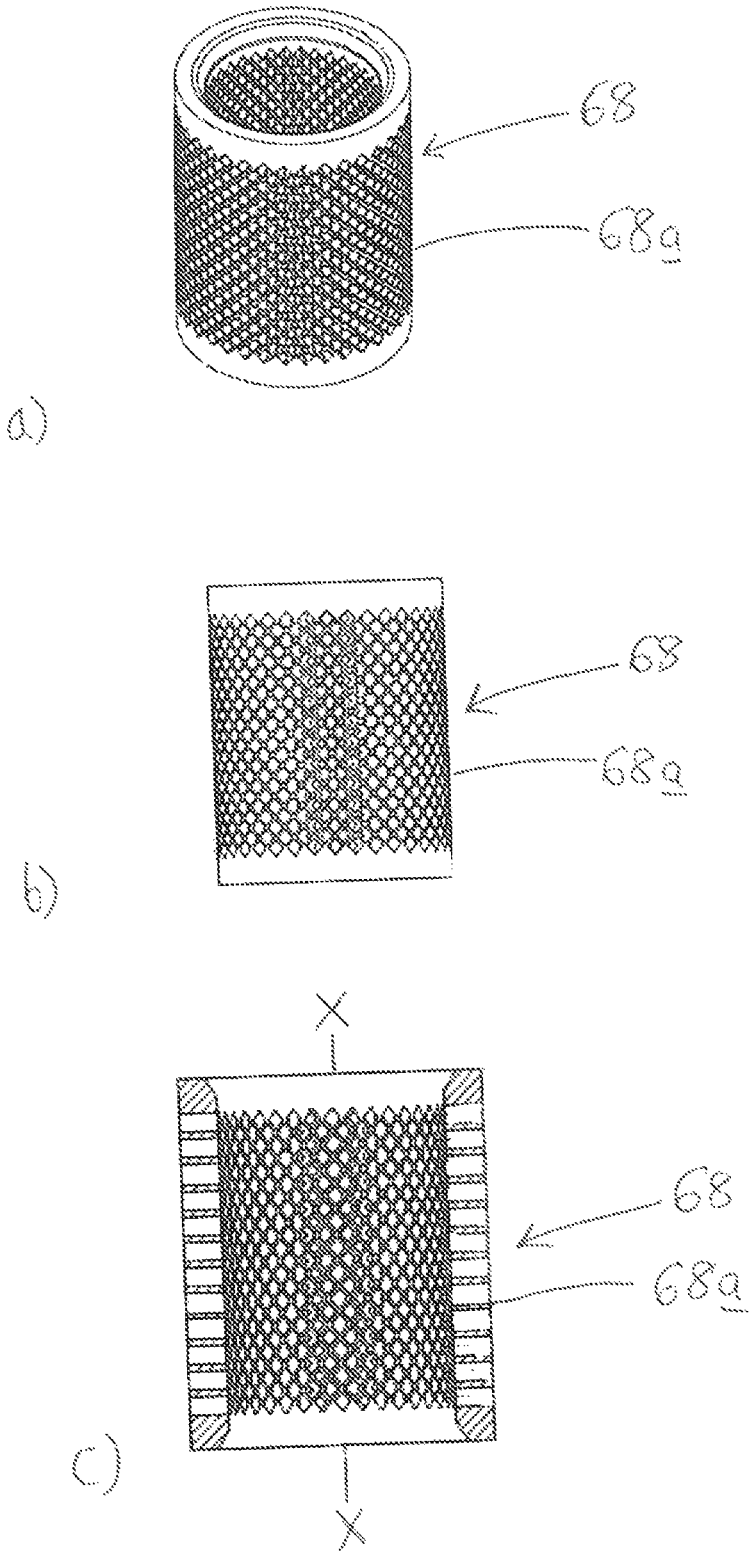

One example of polymeric sealing element 68 is illustrated in FIG. 8. In this example, the sealing element 68 is a generally cylindrical tube with a honeycomb mesh wall structure 68*a*. As can best be seen in FIG. 8*c*, the apertures in the honeycomb mesh wall structure extend from the radially outward surface to the radially inward surface of the sealing element generally perpendicular to the longitudinal axis X of the sealing element 68. The sealing element 68 is preferably formed by machining a cylindrical bar of polymer.

In this embodiment of seal assembly 42, the two tubular walls are provided with an array of slots which extend generally parallel to the longitudinal axis A of the RPCD 10. Hydraulic ports (not shown) are provided through the housing 14 connecting these slots to the exterior of the housing 14, so that, in use, lubricant may be circulated through these ports into the central bore of the seal assembly 42 between the two seals of the seal assembly 42, and between the lowermost seal of the seal assembly 42 and the lowermost packing element 18 of the RPCD 10. It will be appreciated that, by virtue of the supply of lubricant to these regions, the lubricant may assist in further reducing the frictional forces between the seal elements 66, 68/packing element 18 and the drill string when dosed around the drill string.

It may also provide a floating fluid seal or hydrodynamic film between the polymeric seal element 68 and the drill string that will assist in actively sealing around the drill string. It may be necessary to reduce slightly the force exerted by the piston 20 on the packing unit 18 to achieve this.

The lubricant may be drilling fluid or hydraulic oil.

Movement of the sealing assembly 42 relative to the RPCD 10 is substantially prevented by means of a plurality of hydraulically actuated locking dogs 56 which are best illustrated in FIGS. 4 and 5. In this embodiment of the invention, two sets of locking dogs 56 are provided—an upper set, which is located in the first part 14*a* of the housing 14 of the uppermost BOP 12*a*, and a lower set, which is located in the second combined housing part 40 between the middle BOP 12*b* and the lowermost BOP 12*c*. It should be appreciated that the locking dogs 56 need not be in exactly those locations. Also in this embodiment of the invention, each set comprises a plurality of locking dogs 56 which are located in an array of apertures around a circumference of the housing as best illustrated in FIG. 3

In this embodiment of the invention, each locking dog 56 has a non-circular transverse cross-section and is located in a correspondingly shaped aperture in the housing 14 which extends from the exterior of the housing 14 into the central bore of the housing generally perpendicular to the longitudinal axis A of the RPCD 10. Rotation of the locking dog 56 within the aperture is therefore prevented. Sealing devices 58 are provided in the longitudinal surface of each locking dog 56 to provide a substantially fluid tight seal between the locking dog 56 and the housing 14, whilst permitting the locking dog 56 to slide within the housing 14 generally perpendicular to the longitudinal axis A of the RPCD 10. In this example, each sealing device 58 comprises an elastomeric ring seal which is located in a groove around the longitudinal surface of the locking dog 56. Also in this example, two sets of two ring seals are provided.

A radially outward end of each locking dog 56 is provided with an actuating stem 70 which extends into a hydraulic connector 72 mounted in the aperture at the exterior surface of the housing 14. Sealing devices are provided between the hydraulic connector 72 and the housing 14 and between the hydraulic connector 72 and the stem 70, so that the hydraulic connector 72 and stem 60 form a piston and cylinder arrangement. The locking dog 56 may therefore be pushed into a locking position in which a radially inward end of the locking dog 56 extends into the central bore of the housing 14 by the supply of pressurised fluid to the hydraulic connector 72.

The RDD 42 is dropped or lowered in the in the uppermost end of the RPCD 10 with the uppermost set of locking dogs 56 retracted into the housing 14 (as illustrated in FIG. 1) whilst the lowermost set of locking dogs 56 are in the locking position (as illustrated in FIG. 5). The RDD 42 thus comes to rest with its lowermost end in engagement with the lowermost locking dogs 56. Once the RDD 42 is in this position, hydraulic fluid is supplied to the uppermost hydraulic connectors 72 to push the uppermost locking dogs 56 into the locking position in which their radially inward ends extend into the central bore of the housing 14 (as illustrated in FIGS. 2, 4 and 5). The RDD 42 is positioned such that when the locking dogs 56 are in the locking position it lies between the two sets of locking dogs 56, and an end of the RDD 42 engages with each of the locking dogs 56. By virtue of this, longitudinal movement of the RDD 42 in the RPCD 10 is prevented, or at least significantly restricted.

Although not essential, in this example, the radially inward end of each locking dog 56 is provided with a shoulder 56*a* which engages with an end of the RDD 42.

By virtue of using locking dogs which can be retracted into the housing 14 wall, it will be appreciated that the mechanical locking of the RDD 42 does not impact on the diameter of the central bore of the BOP stack. Moreover, by retracting the locking dogs 56 into the housing 14 wall, the accumulation of debris on these features when no sealing assembly is present, can be avoided.

Instead of a sealing assembly 42, the locking dogs 56 described above can be used to retain a different tubular component in the central bore of the RPCD 10. Such an alternative to the sealing assembly 42 could be a snubbing adaptor with a rotating control device (RCD) mechanism at the uppermost end thereof. In this case, to retain the component in the RPCD 10 when subjected to pressure from below, the uppermost locking dogs 56 may engage with a shoulder or groove provided in the radially outermost surface of the component, rather than the uppermost end of the component. This allows an RCD mechanism or the like mounted on the tubular component to be located at the very uppermost end of the RPCD 10, or even to extend out of the RPCD 10 into the upper riser portion 48.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A pressure containment device for sealing around rotating drill string during drilling of a well bore, comprising an actuator assembly and a seal assembly, the actuator assembly being operable to engage with the seal assembly to prevent significant rotation of the seal assembly with respect to the actuator assembly and to force the seal assembly into sealing engagement with a drill string mounted in the pressure containment device, the seal assembly comprising:

a tubular seal sleeve having a radially inward portion made from a non-elastomeric polymer, and a radially outward portion made from an elastomer, wherein, the radially inward portion of the seal sleeve contains a plurality of apertures, and elastomeric parts of the radially outward portion of the seal sleeve extend into the plurality of apertures of the radially inward portion.

2. A pressure containment device according to claim 1 wherein the actuator assembly includes an annular packing unit and an actuator operable to reduce the internal diameter of the annular packing unit.

3. A pressure containment device according to claim 2 wherein the seal sleeve is in use positioned generally centrally of the packing unit so that the packing unit surrounds at least a portion of the seal sleeve.

4. A pressure containment device according to claim 2 wherein the actuator comprises a piston movable generally parallel to a longitudinal axis of the pressure containment device by a supply of pressurised fluid to the pressure containment device.

5. A pressure containment device according to claim 1 wherein the radially inward portion of the seal sleeve is made from one of polytetrafluoroethylene (PTFE), a PTFE-based polymer or ultra-high molecular weight polyethene (UHMWPE).

6. A pressure containment device according to claim 1 wherein the radially inward portion of the seal sleeve contains an additive or filler.

7. A pressure containment device according to claim 6 wherein the additives or filler comprises at least one of fibreglass, molybdenum disulphide, tungsten disulphide or graphite.

8. A pressure containment device according to claim 1 wherein the radially outward portion of the seal sleeve is made from one of polyurethane or hydrogenated nitrile butadiene rubber.

9. A pressure containment device according to claim 1 further comprising a second actuator assembly and seal assembly, the second actuator assembly being operable to engage with the second seal assembly to prevent significant rotation of the second seal assembly with respect to the second actuator assembly and to force the second seal assembly into sealing engagement with a drill string mounted in the pressure containment device, the second seal assembly also comprising a tubular seal sleeve having a radially inward portion made from a non-elastomeric polymer, and a radially outward portion made from an elastomer.

10. A pressure containment device according to claim 9 further comprising means to direct lubricating fluid to the region around the drill string between the first and second seal assemblies.

11. A pressure containment device according to claim 1 wherein the actuator assembly is operable to force the seal assembly into sealing engagement with a drill string mounted in the pressure containment device whilst allowing rotation of the drill string relative to the pressure containment device.

12. The pressure containment device as recited in claim 1, wherein the radially inward portion of the seal sleeve is formed as a cylindrical tube.

13. The pressure containment device as recited in claim 12, wherein the plurality of apertures of the radially inward portion of the seal sleeve are arranged so as to have a honeycomb mesh structure.

14. A method of containing pressure in a well bore, a drill string extending into the well bore, the method comprising mounting a pressure containment device around the drill string, the pressure containment device comprising an actuator assembly and a seal assembly, the seal assembly comprising a tubular seal sleeve having a radially inward portion made from a non-elastomeric polymer, and a radially outward portion made from an elastomer, wherein the radially inward portion of the seal sleeve contains a plurality of apertures, elastomeric parts of the radially outward portion of the seal sleeve extend into the plurality of apertures of the radially inward portion, and the method comprises:

operating the actuator assembly to engage with the seal assembly to prevent significant rotation of the seal assembly with respect to the actuator assembly and to force the radially inward portion of the seal sleeve into sealing engagement with the drill string, whilst allowing rotation of the drill string relative to the pressure containment device.

15. The method of claim 14 wherein the step of operating the actuator assembly comprises supplying pressurised fluid to the pressure containment device.

16. The method of claim 15 further comprising varying the force exerted on the drill string by the seal sleeve by varying the pressure of fluid supplied to the actuator assembly.

17. A pressure containment device for sealing around rotating drill string during drilling of a well bore, comprising an actuator assembly and a seal assembly, the actuator assembly being operable to engage with the seal assembly to prevent significant rotation of the seal assembly with respect to the actuator assembly and to force the seal assembly into sealing engagement with a drill string mounted in the pressure containment device, the seal assembly comprising:

a tubular seal sleeve having a radially inward portion made from a non-elastomeric polymer, and a radially outward portion made from an elastomer, wherein, the radially inward portion of the seal sleeve contains a plurality of radially-extending apertures, and elastomeric parts of the radially outward portion of the seal sleeve extend into the plurality of radially-extending apertures of the radially inward portion.

* * * * *